US008662650B2

(12) United States Patent
Ono et al.

(10) Patent No.: US 8,662,650 B2
(45) Date of Patent: Mar. 4, 2014

(54) LIQUID DROPLET DISCHARGE HEAD

(71) Applicants: Masashi Ono, Okazaki (JP); Koichiro Hara, Nagoya (JP); Atsushi Ito, Nagoya (JP); Shohei Koide, Nagoya (JP)

(72) Inventors: Masashi Ono, Okazaki (JP); Koichiro Hara, Nagoya (JP); Atsushi Ito, Nagoya (JP); Shohei Koide, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/624,453

(22) Filed: Sep. 21, 2012

(65) Prior Publication Data

US 2013/0257993 A1 Oct. 3, 2013

(30) Foreign Application Priority Data

Mar. 29, 2012 (JP) ..... 2012-078118

(51) Int. Cl.
*B41J 2/17* (2006.01)
*B41J 2/045* (2006.01)

(52) U.S. Cl.
USPC ..... 347/94; 347/68; 347/71

(58) Field of Classification Search
None
See application file for complete search history.

(56) References Cited

U.S. PATENT DOCUMENTS

| | | | | |
|---|---|---|---|---|
| 6,905,202 | B2 * | 6/2005 | Shimamoto et al. | 347/94 |
| 7,837,315 | B2 * | 11/2010 | Mizutani et al. | 347/93 |
| 8,025,370 | B2 * | 9/2011 | Nagate et al. | 347/71 |
| 2004/0056937 | A1 | 3/2004 | Ito | |

FOREIGN PATENT DOCUMENTS

| | | | | |
|---|---|---|---|---|
| JP | 2004-106395 | A | 4/2004 | |
| JP | 2006-347036 | * | 12/2006 | B41J 2/045 |
| JP | 2006-347036 | A | 12/2006 | |

* cited by examiner

*Primary Examiner* — Geoffrey Mruk
(74) *Attorney, Agent, or Firm* — Scully, Scott, Murphy & Presser, PC

(57) ABSTRACT

A liquid droplet discharge head includes a plurality of discharge unit parts, each of which extends in a first direction. The discharge unit parts are arranged in a second direction intersecting with the first direction. Each of the discharge unit parts includes: a nozzle column configured by a plurality of nozzles; a liquid droplet discharge surface; a common flow path; a plurality of pressure chambers; a damper chamber extending in the first direction; a damper wall arranged between the damper chamber and the common flow path; and a pillar part connecting the damper wall and a separate wall that is different from the damper wall in the damper chamber. A position of the pillar part of at least one discharge unit part of the discharge unit parts in the first direction is deviated from a position of the pillar part in the other discharge unit part.

8 Claims, 7 Drawing Sheets

LIQUID DROPLET DISCHARGE HEAD

CROSS-REFERENCE TO RELATED APPLICATIONS

This application claims priority from Japanese Patent Application No. 2012-078118 filed on Mar. 29, 2012, the entire subject matter of which is incorporated herein by reference.

TECHNICAL FIELD

The invention relates to a liquid droplet discharge head of a liquid droplet discharge apparatus.

BACKGROUND

A liquid droplet discharge apparatus is an apparatus configured to discharge liquid droplets. For example, the liquid droplet discharge apparatus discharges liquid droplets such as ink toward a target for printing. An inkjet printer is one example of the liquid droplet discharge apparatus.

There have been proposed an inkjet head of an inkjet printer. For example, a first kind of the related-art inkjet head includes a cavity unit having a cavity plate, a base plate, an interposition plate, two manifold plates, a cover plate and a nozzle plate stacked thereto. The interposition plate is formed with a concave part (damper chamber) having a concave shape, which is opened toward the upper base plate with leaving a thin bottom plate part (damper wall) on a lower surface thereof. The concave part is formed to have a length substantially corresponding to a row of pressure chambers along a substantially longitudinal direction of the manifold chamber, so that the damper wall configures a part of an upper wall of the manifold chamber (common flow path).

Thereby, pressure change of the manifold chamber, which is caused when discharging liquid droplets, for example, is absorbed by vibration of the damper wall. As a result, a change in injection characteristics of liquid droplets is suppressed to prevent deterioration of printing performance.

In the meantime, there have been proposed a second kind of related-art inkjet head in which, when stacking a base plate having a pressure chamber formed therein, a spacer plate, a manifold plate in which a manifold chamber is provided at a position at least partially overlapping with the pressure chamber, a damper plate having a damper wall and a nozzle plate having a nozzle, the damper plate is inserted with abutting on an upper or lower part of the manifold plate. The damper plate includes a plate material having a plurality of concave parts formed at a position facing the manifold chamber with a partition wall interposed therebetween and a thin film material configuring a flexible damper wall partitioning the manifold chamber and the concave parts and adhered to the plate material.

SUMMARY

Illustrative aspects of the invention provide a liquid droplet discharge head capable of securing a sufficient damper effect while suppressing excessive vibration of a damper wall.

According to one illustrative aspect of the invention, there is provided a liquid droplet discharge head comprising: a plurality of discharge unit parts, each of the discharge unit parts extends in a first direction and is configured to discharge liquid droplets. The discharge unit parts are arranged in a second direction intersecting with the first direction. Each of the discharge unit parts comprises: a nozzle column configured by a plurality of nozzles arranged in the first direction; a liquid droplet discharge surface in which the nozzle column is arranged; a common flow path, which comprises a plurality of ink introduction ports for supplying ink to the nozzles, and which extends in the first direction; a plurality of pressure chambers, which is arranged between the ink introduction ports and the nozzles, and which is configured to receive a pressure for discharging the ink from the nozzles; a damper chamber, which is arranged at a position facing the common flow path, and which extends in the first direction; a damper wall, which is arranged between the damper chamber and the common flow path, and which is configured to be bent depending on pressure variation in the common flow path; and a pillar part which connects the damper wall and a separate wall that is different from the damper wall in the damper chamber. A position of the pillar part of at least one discharge unit part of the discharge unit parts in the first direction is deviated from a position of the pillar part in the other discharge unit part.

DETAILED DESCRIPTION

General Overview

Figure 1:
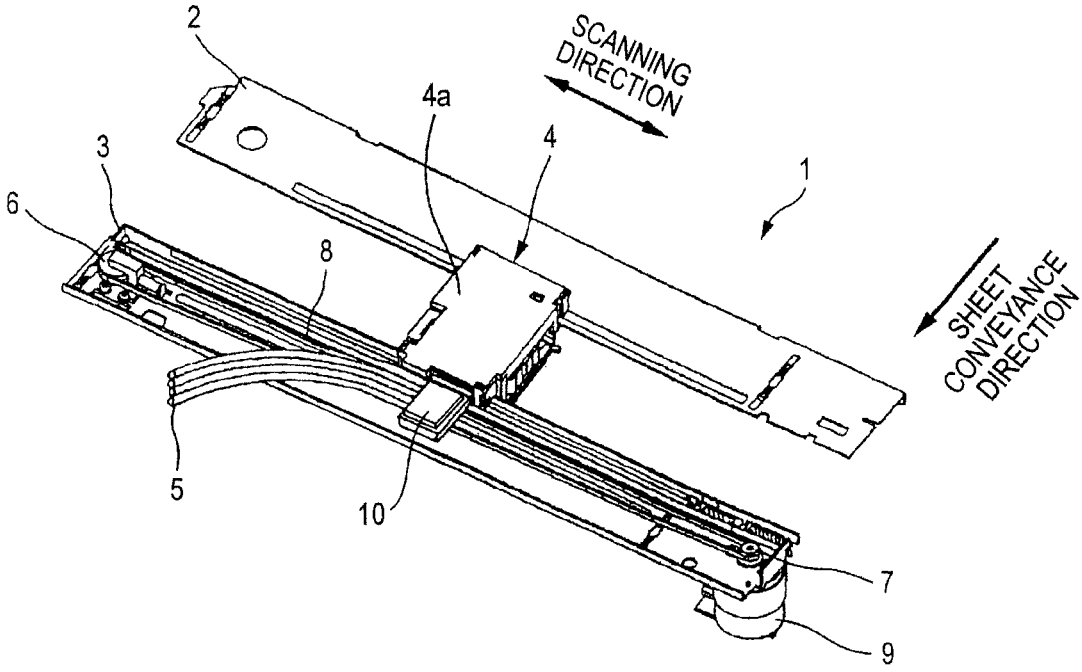
FIG. 1 is a perspective view of main parts of an inkjet printer according to a first exemplary embodiment of the invention.

However, according to the first kind of related-art inkjet head, when the pressure variation in the manifold (common flow path) is increased, which is caused when continuously discharging the ink, for example, the amplitude of the damper wall is increased at a longitudinally central part of the damper chamber, so that the ink may be non-uniformly discharged.

According to the second kind of related-art inkjet head, the damper chamber is finely partitioned and the damper wall is partitioned in the same manner. Thus, the damper walls of the respectively partitioned chambers may not sufficiently vibrate with respect to the pressure variation of the manifold, so that the sufficient damper effect may not be obtained.

Therefore, illustrative aspects of the invention provide a liquid droplet discharge head capable of securing a sufficient damper effect while suppressing excessive vibration of a damper wall.

According to a first illustrative aspect of the invention, there is provided a liquid droplet discharge head comprising:

a plurality of discharge unit parts, each of the discharge unit parts extends in a first direction and is configured to discharge liquid droplets. The discharge unit parts are arranged in a second direction intersecting with the first direction. Each of the discharge unit parts comprises: a nozzle column configured by a plurality of nozzles arranged in the first direction; a liquid droplet discharge surface in which the nozzle column is arranged; a common flow path, which comprises a plurality of ink introduction ports for supplying ink to the nozzles, and which extends in the first direction; a plurality of pressure chambers, which is arranged between the ink introduction ports and the nozzles, and which is configured to receive a pressure for discharging the ink from the nozzles; a damper chamber, which is arranged at a position facing the common flow path, and which extends in the first direction; a damper wall, which is arranged between the damper chamber and the common flow path, and which is configured to be bent depending on pressure variation in the common flow path; and a pillar part which connects the damper wall and a separate wall that is different from the damper wall in the damper chamber. A position of the pillar part of at least one discharge unit part of the discharge unit parts in the first direction is deviated from a position of the pillar part in the other discharge unit part.

According to a second illustrative aspect of the invention, in the damper chamber, the pillar part extends in the second direction, and the pillar part partitions the damper chamber into a first damper chamber and a second damper chamber such that the first damper chamber and the second damper chamber communicate with each other.

According to a third illustrative aspect of the invention, the liquid droplet discharge head further comprises: a spacer member comprising a concave part arranged at the liquid droplet discharge surface-side of the damper wall. The damper chamber is configured by the damper wall and the concave part.

According to a fourth illustrative aspect of the invention, the pillar part extends from the spacer member and is adhered to the damper wall.

According to a fifth illustrative aspect of the invention, the pillar part extends from the damper wall and is adhered to the spacer member.

According to a sixth illustrative aspect of the invention, the spacer member comprises a plurality of through-holes penetrating in a third direction orthogonal to the liquid droplet discharge surface.

According to a seventh illustrative aspect of the invention, when seen from a plan view, the discharge surface is formed with a plurality of convex parts in two columns along the first direction, and the spacer member is formed with the through-holes at positions corresponding to at least between the two columns of the convex parts along the first direction.

According to an eighth illustrative aspect of the invention, the plurality of discharge unit parts is configured for each color of liquid droplets to be discharged and comprises: a first unit group formed by a discharge unit part discharging black liquid droplets; and a second unit group formed by a discharge unit part discharging liquid droplets having a color other than black. The damper chamber of the discharge unit part at a first end of the first unit group in the second direction and the damper chamber of the discharge unit part at a second end of the first unit group have the same arrangement of the pillar part.

According to the above-described illustrative aspects of the invention is, the damper chambers are provided therein with the pillar parts, so that it is possible to suppress the excessive vibration of the damper walls, thereby suppressing the non-uniform discharge of the ink. Further, the position of the pillar part of at least one discharge unit part is staggered regarding the position of the pillar part of the other discharge unit part. Thereby, the discharge defects, which may be caused due to the uniform arrangement of the pillar parts, are suppressed.

EXEMPLARY EMBODIMENTS

Hereinafter, exemplary embodiments of the invention will be described with reference to the drawings. Incidentally, the invention is not limited to the exemplary embodiments.

First Exemplary Embodiment

1. Configuration of Main Parts of Inkjet Printer 1

FIG. 1 is a perspective view showing main parts of an inkjet printer 1 having a liquid droplet discharge head 14, which is one example of the liquid droplet discharge head of the invention. A configuration of the inkjet printer 1 is described with reference to FIG. 1. Incidentally, in this exemplary embodiment, a side from which ink is discharged is referred to as a lower surface and a lower side, and an opposite side thereto is referred to as an upper surface and an upper side.

As shown in FIG. 1, the inkjet printer 1 includes a pair of guide rails 2, 3 that is substantially parallel with each other, and a head unit 4. The head unit 4 is supported to the guide rails 2, 3 so that it can slide in a scanning direction (one example of a second direction). The head unit 4 is connected with four ink supply tubes 5 that supply inks of four colors (for example, black, cyan, magenta and yellow) from four ink cartridges (not shown) mounted to a main body-side, respectively.

Figure 2:
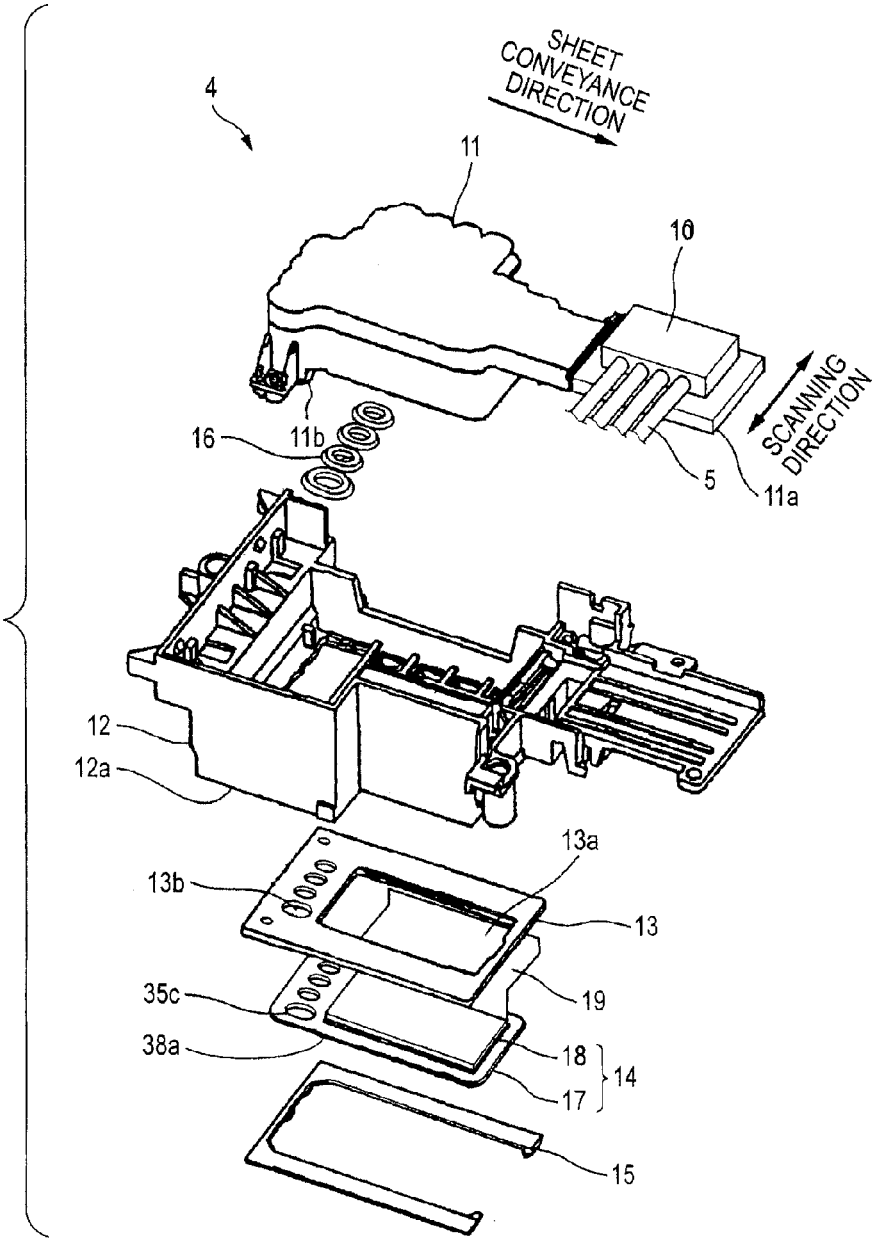
FIG. 2 is an exploded perspective view showing a configuration of a head unit of the inkjet printer of FIG. 1.

The head unit 4 is mounted with a liquid droplet discharge head 14 (refer to FIG. 2). The liquid droplet discharge head 14 is configured to discharge the ink toward a recording sheet that is conveyed in a sheet conveyance direction (one example of a first direction) perpendicular to the scanning direction below the liquid droplet discharge head 14.

The head unit 4 is attached to a timing belt 8 wound on a pair of pulleys 6, 7. The timing belt 8 is provided to be substantially parallel with the guide rail 3. One pulley 7 is provided with a motor 9 that rotates in forward and reverse directions. The pulley 7 rotates in forward and reverse directions, so that the timing belt 8 reciprocates. As a result, the head unit 4 is scanned along the guide rails 2, 3.

2. Configuration of Head Unit 4

As shown in FIG. 2, the head unit 4 includes a buffer tank 11, a seal member 16, a carriage 12, a frame 13, the liquid droplet discharge head 14 and a nozzle protection cover 15. The carriage 12 has a substantial box shape that is opened upward. The buffer tank 11 is accommodated in the carriage 12. The liquid droplet discharge head 14, to which the frame 13 and the nozzle protection cover 15 are adhered, is fixed to a lower surface of a bottom wall 12*a* of the carriage 12 by an adhesive.

A circuit board 4*a* that is electrically connected to the main body-side of the inkjet printer 1 is supported on an upper surface of the carriage 12 (refer to FIG. 1). The buffer tank 11 includes respective reservation chambers (not shown) that reserve inks supplied from the ink cartridges and four ink outlets lib. A plate-shaped arm part 11*a* that is connected to the respective reservation chambers is connected at an upper surface thereof with a joint member 10 enabling the ink supply tubes 5 and the ink reservation chambers to communicate with each other.

3. Configuration of Liquid Droplet Discharge Head 14

Figure 3:
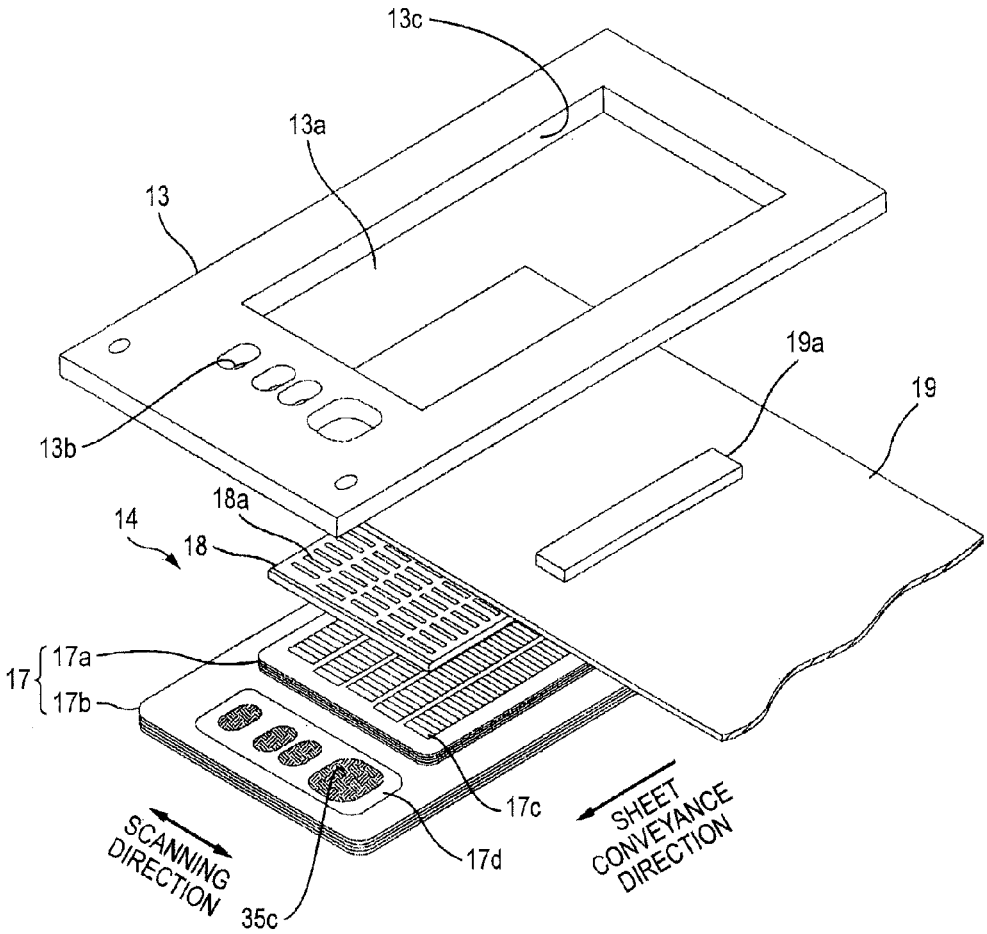
FIG. 3 is an exploded perspective view showing a configuration of a head of the head unit of FIG. 2.

As shown in FIG. 3, the liquid droplet discharge head 14 includes a flow path unit 17 having a plurality of flow paths formed therein and an actuator 18 stacked on an upper surface thereof. Incidentally, the flow path unit 17 of the liquid droplet discharge head 14 according to the exemplary embodiment of the invention is configured by discharge unit parts B1, B2, C1, M1, Y1 having a flow path structure for each channel and integrally formed (refer to FIGS. 4A and 4B).

The discharge unit parts B1, B2, C1, M1, Y1 are formed therein with a plurality of flow paths 40 (which will be described later) in the sheet conveyance direction (e.g., first direction), respectively. The discharge unit parts B1, B2, C1, M1, Y1 are arranged in a line in the scanning direction (e.g., second direction), thereby configuring the flow path unit 17. As specifically described later, according to the flow path unit 17 of this exemplary embodiment, a plurality of plates is stacked in a third direction that is orthogonal to the sheet conveyance direction and the scanning direction, thereby integrally forming the discharge unit parts B1, B2, C1, M1, Y1. Incidentally, the discharge unit parts B1, B2, C1, M1, Y1 may be separately formed and then combined to configure the flow path unit.

The flow path unit 17 has ink flow paths 40 configured to guide the ink from four ink supply ports 35*c* to a plurality of nozzles 38*b*, which is formed on a liquid droplet discharge surface 38*a*, via pressure chambers 17*c*. The flow path unit 17 includes a lower wide part 17*b* and an upper narrow part 17*a* narrower than the wide part in the scanning direction and the sheet conveyance direction. The narrow part 17*a* is arranged on an upper surface of the wide part 17*b*. The actuator 18 is a piezoelectrically-actuated actuator having a plate shape that selectively applies a pressure for discharging the ink to the pressure chambers 17*c*. The actuator 18 is stacked on an upper surface of the narrow part 17*a*.

One end portion of a flexible flat cable 19 for electrical connection with the circuit board 4*a* overlaps and is adhered to an upper surface of the actuator 18, and the other end portion of the flexible flat cable 19 is withdrawn in the scanning direction. The flexible flat cable 19 is mounted with an IC chip 19*a* that transfers print data to the actuator 18 and selectively drives the same.

The upper surface of the actuator 18 is formed with a plurality of surface electrodes 18*a*, and the surface electrodes 18*a* are bonded to terminals (not shown) exposed from a lower surface of the flexible flat cable 19, so that the surface electrodes and the terminals are electrically conducted. The other end portion of the flexible flat cable 19 is withdrawn upward through an opening 13*a* of a frame 13 having a rectangular frame plate shape and is connected to the circuit board 4*a* through a slit (not shown) penetrating the bottom wall 12*a* of the carriage 12, so that it is electrically connected to the main body-side.

The frame 13 is fixed to the flow path unit 17 by a sheet adhesive, and the actuator 18 is disposed and exposed upward in a central opening 13*a* of the frame 13. The frame 13 is provided with four through-holes 13*b* in a line in the scanning direction. The through-holes 13*b* communicate with the ink supply ports 35*c* of the flow path unit 17 via a filter 17*d* for removing foreign materials in the ink.

4. Configuration of Flow Path Unit 17

(1) Overall Configuration

Figure 4A:
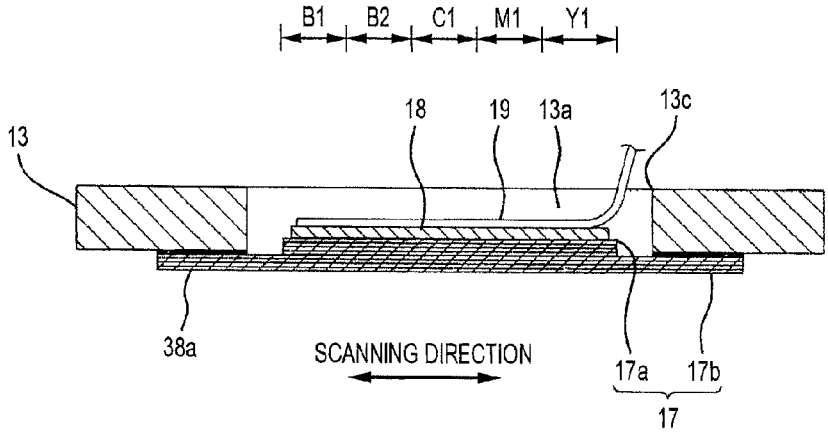
FIG. 4A is a sectional view of the assembled head of FIG. 3 with a part of an internal structure thereof being omitted.
Figure 4B:
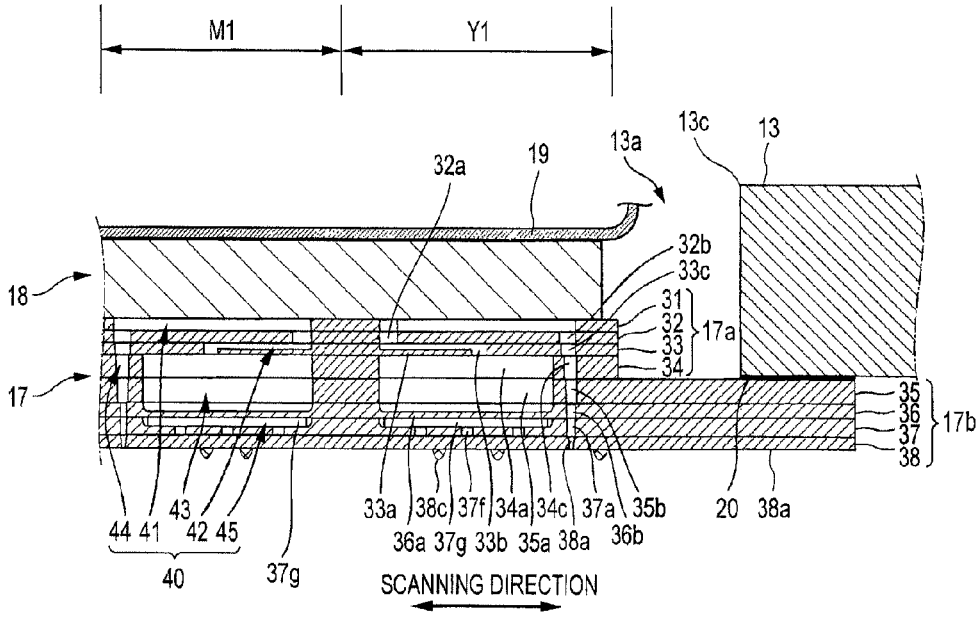
FIG. 4B is a partially enlarged view showing the internal structure of FIG. 4A.
Figure 5:
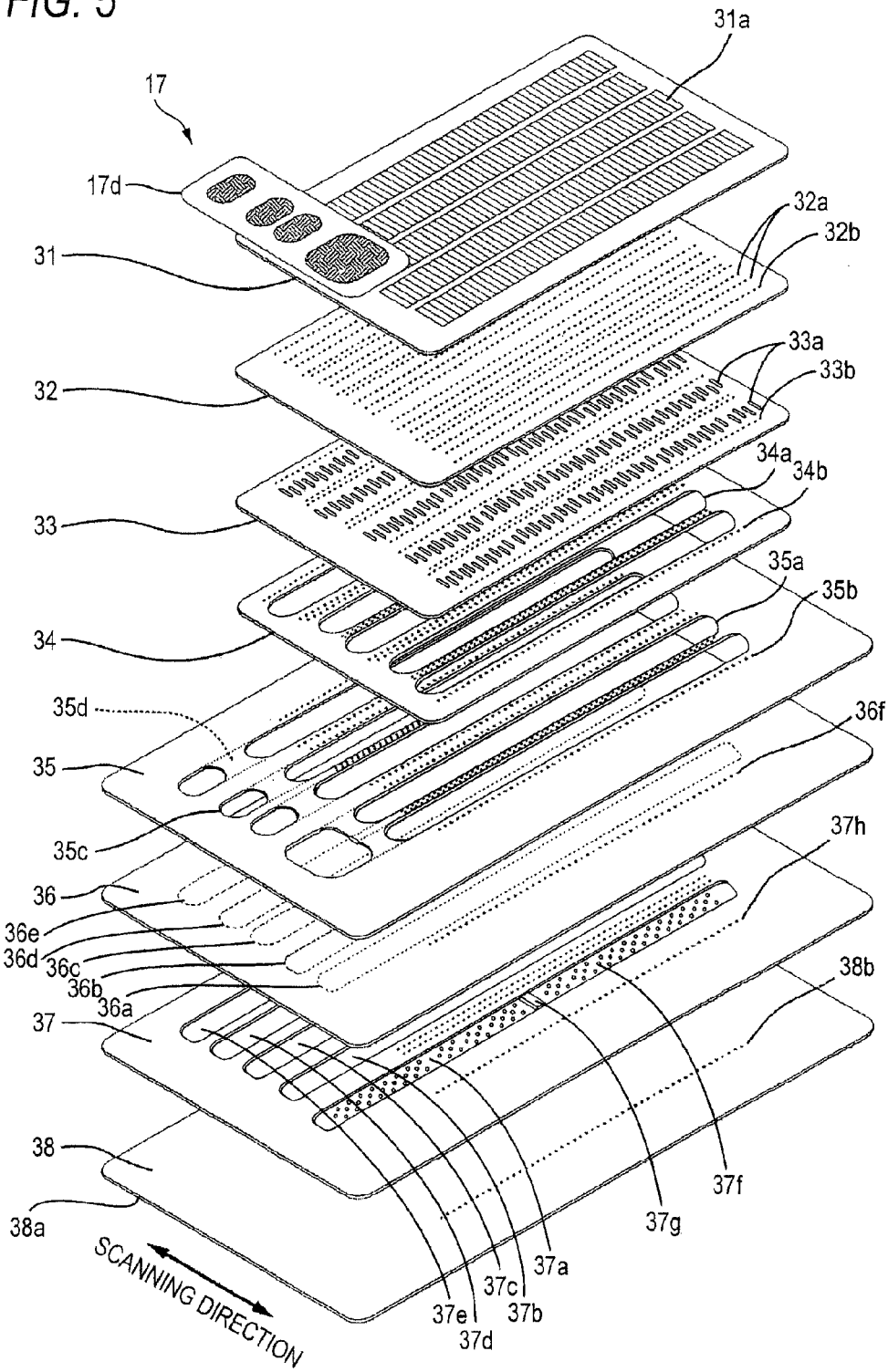
FIG. 5 is an exploded perspective view showing a schematic configuration of a flow path unit of the head of FIG. 3.

As shown in FIGS. 4A, 4B and 5, the flow path unit 17 is configured by the wide part 17*a* and the narrow part 17*b*. The flow path unit 17 is configured by a pressure chamber plate 31, a cover plate 32, a throttle plate 33, a first manifold plate 34, a second manifold plate 35, a damper plate 36, a spacer plate 37 (spacer member) and a nozzle plate 38 that are stacked and adhered in corresponding order from the upper. The narrow part 17*a* has a shape that is smaller than the wide part 17*b*, when seen from a plan view, in a long side direction (e.g., sheet conveyance direction) and a short side (e.g., scanning direction). Further, the narrow part 17*a* has the substantially same size as the actuator 18, when seen from a plan view (refer to FIG. 3).

In this exemplary embodiment, the nozzle plate 38 is formed of a resin sheet such as polyimide, and the other plates 31 to 37 are formed of metal plates such as stainless steel, for example. Plate thickness of the respective plates 31 to 38 is 50 μm, 50 μm, 50 μm, 125 μm, 125 μm, 50 μm, 100 μm and 50 μm in order from the top layer. The respective plates 31 to 38 are formed with openings or concave parts by etching, laser processing, plasma jet processing and the like. The respective plates 31 to 38 are stacked, so that the respective openings and recesses communicate and form the ink flow paths 40.

The four upper plates 31 to 34 are smaller than the four lower plates 35 to 38 in the long side direction and the short side direction, when seen from a plan view. The four upper plates 31 to 34 are positioned such that the openings or recesses form the respective ink flow paths 40. The four upper plates are arranged so that they are included in the four lower plates 35 to 38, when seen from a plan view, with the ink supply ports 35*c* of the second manifold plate 35 being exposed. That is, the four upper plates 31 to 34 configure the narrow part 17*a*, and the four lower plates 35 to 38 configure the wide part 17*b*.

(2) Configuration of Each Plate

As shown in FIG. 5, the pressure chamber plate 31 is formed with a plurality of pressure chamber holes 31*a*. The pressure chamber holes 31*a* have a long hole shape extending in a short side direction of the pressure chamber plate 31 and are provided in five columns in the short side direction along a long side direction of the pressure chamber plate 31. The columns of the pressure chamber holes 31*a* include two columns for black ink (two columns of the front in FIG. 5) and each column for cyan, magenta and yellow inks. The actuator 18 is adhered to the pressure chamber plate 31 from the upper, and the cover plate 32 is adhered thereto from the lower, so that the pressure chamber holes 31*a* form the pressure chambers 41 having an internal space (refer to FIG. 4B).

The cover plate 32 is formed with communication holes 32*a* through-holes 32*b*. The communication holes 32*a* communicate with one end portions (one end portions in the scanning direction) of the pressure chamber holes 31*a* of the pressure chamber plate 31. The through-holes 32*b* communicate with the other end portions of the pressure chamber holes 31*a*.

The throttle plate 33 is formed with throttle recesses 33*a* on an upper surface thereof. The throttle recesses 33*a* have a long recess shape extending in a short side direction of the throttle plate 33. One end portions the throttle recess 33*a* communicate with the communication holes 32*a* of the cover plate 32, and the other end portions thereof are provided with ink introduction ports 33*b* penetrating the lower surface. Incidentally, in this exemplary embodiment, the ink introduction ports 33*b* are formed by through-holes, for example, and become ink introduction ports for introducing the inks into the nozzles 38*b* through common flow paths 43 (which will be described later). The throttle plate 33 is formed with through-holes 33*c* communicating with the through-holes 32*b* of the cover plate 32. The throttle plate 33 is positioned and adhered between the cover plate 32 and the first manifold plate 34, so that the throttle recesses 33*a* form throttle passages 42 (refer to FIG. 4B).

The first manifold plate 34 is formed with manifold holes 34*a* penetrating through the first manifold plate 34. The manifold holes 34*a* are positioned below the pressure chamber holes 31*a* in correspondence to the pressure chamber holes and extend in the column direction (sheet conveyance direction) of the respective columns of the pressure chamber holes 31*a*. The manifold holes 34*a* include five columns of two columns for black ink (two columns of the front in FIG. 5) and each column for cyan, magenta and yellow inks. The respective manifold holes 34*a* communicate with the pressure chambers 41 through the throttle passages 42. The first manifold plate 34 is formed with a plurality of through-holes 34*c*, which communicates with the through-holes 33*c* of the throttle plate 33 and has the same shape as the through-holes, along a longitudinal direction of the respective manifold holes 34*a*.

The second manifold plate 35 is formed with five manifold holes 35*a* and through-holes 35*b* having the same shapes as those of the first manifold plate 34. One end-side of the second manifold plate 35 in the long side direction is formed with four ink supply ports 35*c* for inks of respective colors in a line in the scanning direction.

The throttle plate 33, the first manifold plate 34, the second manifold plate and the damper plate 36 (which will be described later) are stacked and adhered, so that five common flow paths 43 are formed by the manifold holes 34*a*, 35*a* (refer to FIG. 4B).

Incidentally, communication recesses 35*d* that are concave from a lower surface are formed between the ink supply ports 35*c* and manifold holes 35*a* of the second manifold plate 35. The damper plate 36 is adhered to the lower side of the second manifold plate 35, so that the ink supply ports 35*c* and the manifold holes 35*a* communicate with each other, and thus the inks are configured to be supplied from the ink supply ports 35*c* to the manifold holes 35*a*. One ink supply port 35*c* of the front in FIG. 5 of the four ink supply ports 35*c* is larger than the other three ink supply ports 35*c* and is configured to communicate with the two columns of the manifold holes 35*a* for black ink, which is frequently used.

The damper plate 36 has five damper walls 36*a* to 36*e* that are formed to have a thin thickness by depressing locations corresponding to the respective common flow paths 43 from an upper surface thereof. The damper plate 36 is formed with through-holes 36*f*, which communicate with the through-holes 35*b* of the second manifold plate 35 and have the same shape as the through-holes 35*b*, along a longitudinal direction of the respective damper walls 36*a* to 36*e*.

The spacer plate 37 has five concave parts 37*a* to 37*e* that are formed by depressing locations corresponding to the respective damper walls 36*a* to 36*e* from an upper surface thereof. The damper plate 36 is adhered to the spacer plate 37, so that spaces surrounded by the concave parts 37*a* to 37*e* and the damper walls 36*a* to 36*e* form damper chambers 45, respectively. The respective concave parts 37*a* to 37*e* are provided with pillar parts 37*g* extending from a bottom surface. The spacer plate 37 is provided with a plurality of through-holes 37*f* penetrating the spacer plate in a stacking direction (e.g., third direction) of the respective plates. By the through-holes 37*f*, the air is suppressed from pooling when adhering and fixing the spacer plate 37 and the nozzle plate 38. The spacer plate 37 is formed with communication holes 37*h* that communicate with the through-holes 36*f* of the damper plate 36 and have the same shape as the through-holes 36*f*. Incidentally, the configurations of the damper plate 36 and the spacer plate 37 will be specifically described later.

The nozzle plate 38 has a liquid droplet discharge surface 38*a* on a lower surface thereof. The liquid droplet discharge surface 38*a* is formed with nozzles 38*b* that are holes communicating with the through-holes 37*h* of the spacer plate 37. The nozzles 38*b* has five nozzle columns in a short side direction along a long side direction, in which two columns are provided for black ink (two columns of the front in FIG. 5) and one column is respectively provided for cyan, magenta and yellow inks. The liquid droplet discharge surface 38*a* is formed with a plurality of convex portions 38*c*. The convex portions 38*c* are arranged in two columns in substantially parallel with the nozzle columns in an area corresponding to each damper chamber 45, when the convex portions 38*c* are seen from a plan view.

The respective plates 31 to 38 are stacked and adhered, so that the flow path unit 17 of a convex sectional shape having the narrow part 17*a* at the upper part and the wide part 17*b* at the lower part is formed. The through-holes 32*b*, 33*b*, 34*b*, 35*b*, 36*f*, 37*h*, which are formed in the respective plates 32 to 37, communicate with each other, so that outflow paths 44 are formed. The outflow paths 44 communicate with the nozzles 38*b* of the nozzle plate 38. Therefore, the inks introduced from the buffer tank 11 to the ink supply ports 35*c* are first reserved in the common flow paths 43, pass through the ink introduction ports 33*b*, flow to the throttle passages 42, the pressure chambers 41 and the outflow paths 44 in order and are then discharged from the nozzles 38*b*.

That is, the flow paths 40 formed in the flows path unit 17 are configured by the ink supply ports 35*c*, the common flow paths 43, the throttle passages 42, the pressure chambers 41 and the outflow paths 44 (refer to FIG. 4B). The upper surface of the second manifold plate 35 is attached with the filter 17*d* for removing the foreign materials mixed in the inks supplied from the buffer tank 11 such that the filter 17*d* covers the ink supply ports 35*c* (refer to FIG. 3).

(3) Configurations of Damper Plate 36 and Spacer Plate 37

(A) Arrangement of Pillar Parts 37*g*

In the below, the damper plate 36 and the spacer plate 37 are specifically described. As described above, the damper plate 36 and the spacer plate 37 are stacked and adhered, so that the spaces surrounded by the concave parts 37*a* to 37*e* and the damper walls 36*a* to 36*e* form the damper chambers 45, respectively.

As shown in FIGS. 4B to 6C, the concave parts 37*a* to 37*e* are formed with the pillar parts 37*g* extending from the bottom surfaces thereof, respectively. The pillar parts 37*g* extend from the bottom surfaces of the concave parts 37*a* to 37*e* in the stacking direction to a height abutting on the damper walls 36*a* to 36*e* and extend with a length within which the pillar parts do not reach both wall surfaces of the concave parts 37*a* to 37*e* in the width direction (e.g., scanning direction).

That is, clearances are formed between both sides of the pillar parts 37*g* and both wall surfaces of the concave parts 37*a* to 37*e*, and the chambers separated in the longitudinal direction (e.g., sheet conveyance direction) by the pillar parts 37*g* are thus enabled to communicate with each other. Incidentally, upper surfaces of the pillar parts 37*g* and lower surfaces of the damper walls 36*a* to 36*e* are adhered to each other.

Figure 6A:
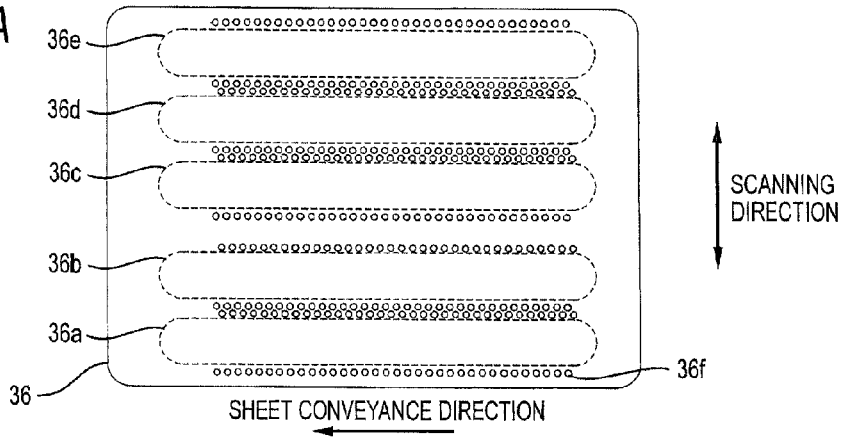
FIG. 6A is a plan view of a damper plate configuring the flow path unit of FIG. 5.
Figure 6B:
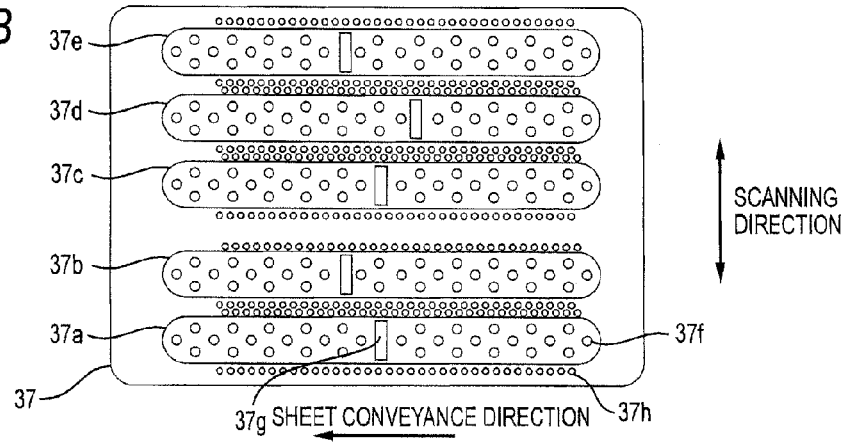
FIG. 6B is a plan view of a spacer plate of FIG. 5

As shown in FIG. 6B, in this exemplary embodiment, the pillar parts 37*g* are arranged as follows. That is, the pillar part 37*g* in the concave part 37*a* is arranged at a substantial center in the longitudinal direction, the pillar part 37*g* in the concave part 37*b* is arranged at a position slightly deviated from the substantial center in the longitudinal direction, the pillar part 37*g* in the concave part 37*c* is arranged at the substantial center in the longitudinal direction, the pillar part 37*g* in the concave part 37*d* is arranged at a position slightly deviated from the substantial center in the longitudinal direction and the pillar part 37*g* in the concave part 37*e* is arranged at a position slightly deviated from the substantial center in the longitudinal direction toward an opposite direction to the deviation direction of the pillar part in the concave part 37*c*.

In this manner, the pillar parts 37*g* are arranged with being staggered, so that the locations at which discharge defects may be caused due to the pillar parts 37*g* are dispersed, and the print defects on the recording sheet can be suppressed. That is, if the pillar parts 37*g* are arranged at the same positions in the concave parts 37*a* to 37*e*, the unnecessary line may be expressed when performing a print job on the recording sheet. According to this exemplary embodiment, the positions of the pillar parts 37*a* are staggered to prevent the unnecessary line from being expressed.

Further, the clearances are formed between both sides of the pillar parts 37*g* and both wall surfaces of the concave parts 37*a* to 37*e*, so that the chambers separated in the longitudinal direction are enabled to communicate with each other. The pillar parts 37*g* are arranged in the vicinity of the centers of the concave parts 37*a* to 37*g*, so that the excessive vibration is suppressed while sufficiently securing the damper effect by the vibrations of the damper wall 36*a* to 36*e*.

Incidentally, in this exemplary embodiment, the pillar parts extend upwards from the bottom surfaces of the concave parts of the spacer plate. However, the same effect is obtained when the pillar parts are configured to extend downward from the lower surfaces of the damper walls and is adhered to the spacer member. Further, in this exemplary embodiment, the clearances are formed between both sides of the pillar parts and both wall surfaces of the concave parts of the spacer plate, so that the chambers of the concave parts separated in the longitudinal direction are enabled to communicate with each other. However, the separated chambers may be enabled to communicate each other by forming the clearances at the centers of the pillar parts or forming through-holes in the pillar parts.

(B) Arrangement of Through-Holes 37*f*

Figure 6C:
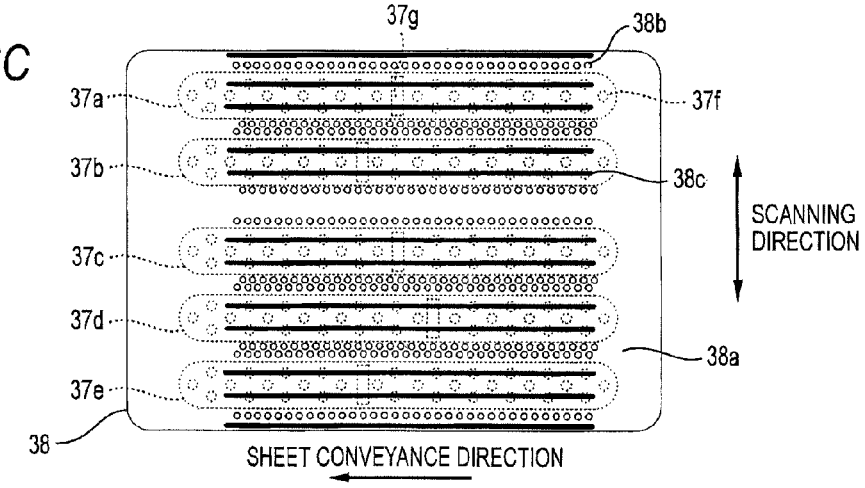
FIG. 6C is a bottom view of a nozzle plate of FIG. 5 (a part of the configuration such as concave parts of the spacer plate is additionally shown with the dotted line)

As shown in FIGS. 5 to 6C, the spacer plate 37 is formed with the plurality of through-holes 37*f* penetrating the spacer plate in the stacking direction. In this exemplary embodiment, the through-holes 37*f* are arranged in the bottom surface of the concave part 37*a* as follows. That is, when seen from a plan view, in the area corresponding to each damper chamber 45, the through-holes 37*f* are arranged in one column along the longitudinal direction at the positions corresponding to between the columns of the convex parts 38*c* arranged in two columns on the liquid droplet discharge surface 38*a* and in each column at both sides of the one column with being staggered in the longitudinal direction. The concave parts 37*b* to 37*e* are formed with the plurality of through-holes 37*f* in the same arrangement as that of the concave part 37*a*.

In this manner, the spacer plate 37 is formed with the plurality of through-holes 37*f*, so that it is possible to suppress the air from pooling when adhering and fixing the spacer plate 37 and the nozzle plate 38. Specifically, since the through-holes 37*f* are provided at the positions corresponding to between the columns of the convex parts 38*c* at which the air is apt to pool, it is possible to suppress the air pooling. By suppressing the air pooling, it is possible to suppress the positional deviation between the spacer plate 37 and the nozzle plate 38, thereby improving the print precision. Further, it is possible to prevent the flow path unit 17 from being damaged by expansion of the pooling air that may be caused when the flow path unit 17 is heated during the manufacturing process of the liquid droplet discharge head 14.

Second Exemplary Embodiment

Subsequently, a head according to a second exemplary embodiment of the invention is described with reference to FIG. 7. The head of the second exemplary embodiment and the liquid droplet discharge head 14 of the first exemplary embodiment are different regarding the configuration of the flow path unit, specifically, regarding the configurations of the manifold, the damper wall, the damper chamber and the nozzle. Therefore, a flow path unit 117 is described based on the difference.

In the second exemplary embodiment, the head includes the flow path unit 117 having a plurality of stacked plates and an actuator (not shown) stacked on a top surface thereof. The flow path unit 117 is integrally formed with thirteen discharge unit parts of four discharge unit parts for black ink and three discharge unit parts for each of cyan, magenta and yellow inks.

The flow path unit 117 is comprised of a pressure chamber plate, a cover plate, a throttle plate, a first manifold plate, a second manifold plate, a damper plate, a spacer plate (spacer member) and a nozzle plate that are stacked and adhered in corresponding order from the upper.

Figure 7:
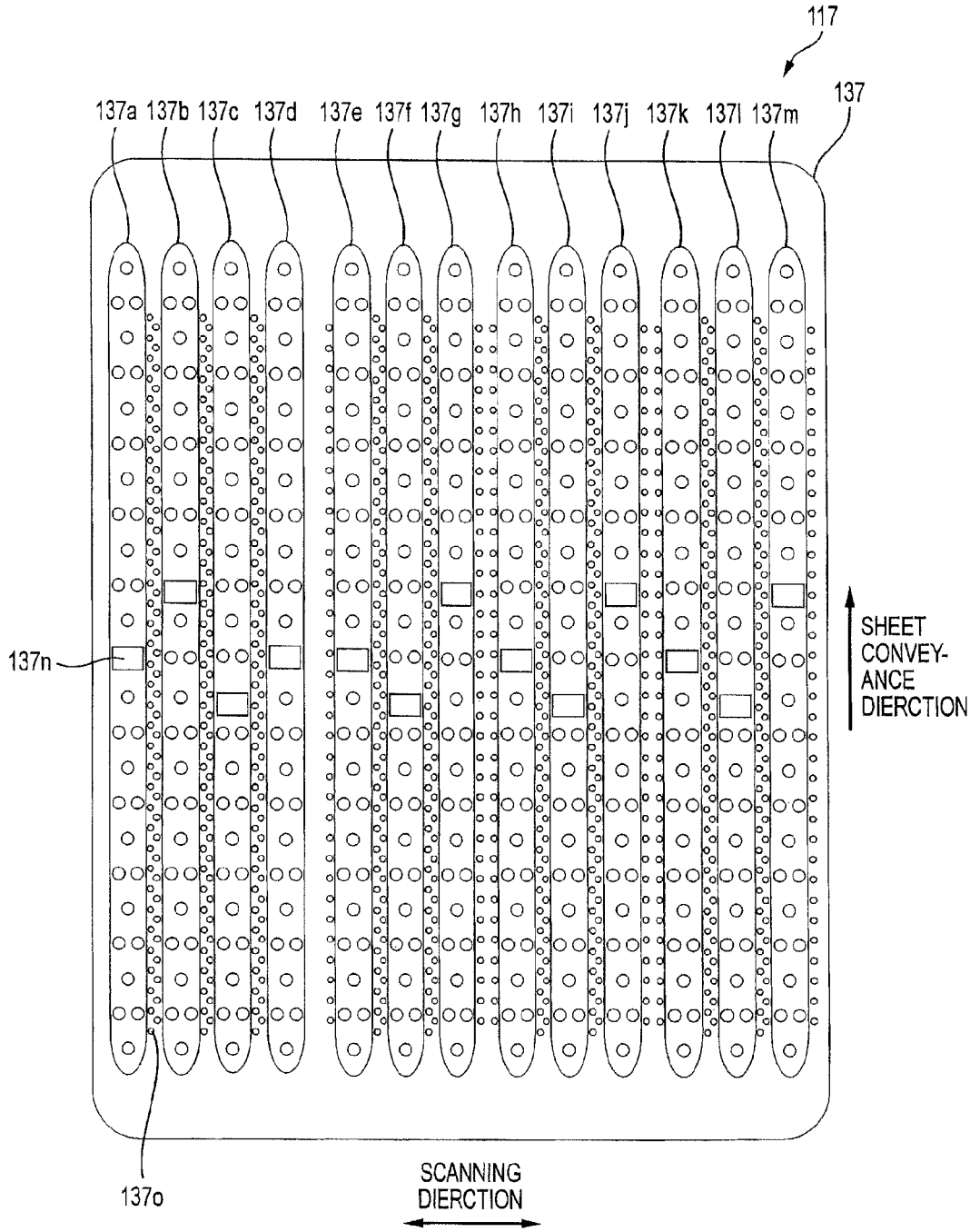
FIG. 7 is a plan view of a spacer plate of a flow path unit of a head according to a second exemplary embodiment of the invention.

As shown in FIG. 7, the spacer plate 137 of the flow path unit 117 is formed with thirteen concave parts 137*a* to 137*m*, and spaces surrounded by the concave parts and the corresponding damper walls configure the thirteen damper chambers. That is, the flow path unit 117 has the thirteen common flow paths, damper walls and damper chambers.

The liquid droplet discharge surface of the flow path unit 117 is provided with twenty four nozzle columns in the short side direction (e.g., scanning direction) along the long side direction (e.g., sheet conveyance direction), which have six columns for each of black, cyan, magenta and yellow inks.

The nozzles for black ink are arranged in a different configuration from the nozzle arrangements of the other color inks (cyan, magenta and yellow inks). The nozzles for color inks are arranged at both sides of positions corresponding to the respective concave parts (damper chambers) 137*e* to 137*m* along the longitudinal direction, when seen from a plan view. On the other hand, the nozzles for black ink are arranged one column by one column at both sides of positions corresponding to the concave parts 137*b*, 137*c* of two intermediate columns of the four columns along the longitudinal direction, respectively, and are arranged in one column at one side of positions corresponding to the concave parts 137*a*, 137*d* of both end columns of the four columns along the longitudinal direction, respectively (refer to arrangement of communication holes 137*o* communicating with the nozzles of FIG. 7).

As shown in FIG. 7, the concave parts 137*a* to 137*m* of the spacer plate 137 are formed with pillar parts 137*n* extending from bottom surfaces thereof.

In the second exemplary embodiment, the pillar parts 137*n* are arranged as follows. That is, the pillar parts 37*g* in the concave parts 137*a*, 137*d* for black ink are arranged at a substantial center in the longitudinal direction, and the pillar parts 137*n* in the concave parts 137*b*, 137*c* are arranged at positions slightly deviated from the substantial center in the longitudinal direction toward opposite directions. Further, the pillar part 137*n* in the concave part 137*e* for cyan ink is arranged at a substantial center in the longitudinal direction, and the pillar parts 137*n* in the concave part 137*f*, 137*g* are arranged at positions slightly deviated from the substantial center in the longitudinal direction toward opposite directions. The pillar parts 137*n* in the concave parts 137*h* to 137*j* for magenta ink and in the concave parts 137*k* to 137*m* for yellow ink are arranged in the same manner as the concave parts 137*e* to 137*g* for cyan ink.

In this manner, the pillar parts 137*n* are arranged with being staggered, so as to disperse the locations at which the discharge defects may be caused due to the pillar parts 137*n* and to suppress the print defects on the recording sheet. That is, if the pillar parts 137*n* are arranged at the same positions in the concave parts 137*a* to 137*m*, the unnecessary line may be expressed when performing a print job on the recording sheet. However, according to this exemplary embodiment, the positions of the pillar parts 137*n* are staggered to prevent the unnecessary line from being expressed.

On the other hand, the reason that the pillar parts 137*n* in the concave parts 137*a*, 137*d* for black ink are equally arranged is as follows. While the nozzles corresponding to the other concave parts are configured in two columns, respectively, the nozzles corresponding to the concave parts 137*a*, 137*d* are configured in one column, respectively. Thus, the influence of the pillar parts 137*n* on the ink discharge is relatively less. Incidentally, the pillars 137*n* in the concave parts 137*a*, 137*d* may be arranged with being staggered.

Modifications to Exemplary Embodiments

Although the preferred exemplary embodiments of the invention have been described with reference to the drawings, a variety of additions, modifications or deletions can be made without departing from the scope of the invention. Specifically, in the above-described exemplary embodiments, the liquid droplet discharge head is configured by the flow path unit having the respective discharge unit parts for black and color inks integrated thereto. However, the respective discharge unit parts may be separately configured and the liquid droplet discharge head may be configured by the flow path unit having combined the same. Further, in the above-described exemplary embodiments, the damper chamber is provided with one pillar part. However, a plurality of pillar parts may be provided and the arrangement and shape of the pillar part may be also changed.

Further, in the above-described exemplary embodiments, the inkjet printer has been exemplified as the liquid droplet discharge apparatus. However, the invention is not limited thereto. For example, the invention can be applied to an apparatus in which an electrically conductive material is discharged to form a wiring pattern on a wiring substrate, an apparatus having a color material injection head that is used in a color filter manufacturing process of a liquid crystal monitor and the like, an apparatus having an electrode material injection head that is used in an electrode forming process of an organic EL display and the like, an apparatus having a bioorganic substance injection head that is used in a bio chip manufacturing process, an apparatus having a sample injection head that is a precise pipette, and the like.

What is claimed is:

1. A liquid droplet discharge head comprising:

a plurality of discharge unit parts, each of the discharge unit parts extends in a first direction and is configured to discharge liquid droplets, wherein the discharge unit parts are arranged in a second direction intersecting with the first direction, wherein each of the discharge unit parts comprises:

a nozzle column configured by a plurality of nozzles arranged in the first direction;

a liquid droplet discharge surface in which the nozzle column is arranged;

a common flow path, which comprises a plurality of ink introduction ports for supplying ink to the nozzles, and which extends in the first direction;

a plurality of pressure chambers, which is arranged between the ink introduction ports and the nozzles, and which is configured to receive a pressure for discharging the ink from the nozzles;

a damper chamber, which is arranged at a position facing the common flow path, and which extends in the first direction;

a damper wall, which is arranged between the damper chamber and the common flow path, and which is configured to be bent depending on pressure variation in the common flow path; and a pillar part which connects the damper wall and a separate wall that is different from the damper wall in the damper chamber, wherein a position of the pillar part of at least one discharge unit part of the discharge unit parts in the first direction is deviated from a position of the pillar part in the other discharge unit part.

2. The liquid droplet discharge head according to claim 1, wherein in the damper chamber, the pillar part extends in the second direction, and the pillar part partitions the damper chamber into a first damper chamber and a second damper chamber such that the first damper chamber and the second damper chamber communicate with each other.

3. The liquid droplet discharge head according to claim 1, further comprising:

a spacer member comprising a concave part arranged at the liquid droplet discharge surface-side of the damper wall, wherein the damper chamber is configured by the damper wall and the concave part.

4. The liquid droplet discharge head according to claim 3, wherein the pillar part extends from the spacer member and is adhered to the damper wall.

5. The liquid droplet discharge head according to claim 3, wherein the pillar part extends from the damper wall and is adhered to the spacer member.

6. The liquid droplet discharge head according to claim 3, wherein the spacer member comprises a plurality of through-holes penetrating in a third direction orthogonal to the liquid droplet discharge surface.

7. The liquid droplet discharge head according to claim 6, wherein when seen from a plan view, the discharge surface is formed with a plurality of convex parts in two columns along the first direction, and the spacer member is formed with the through-holes at positions corresponding to at least between the two columns of the convex parts along the first direction.

8. The liquid droplet discharge head according to claim 1, wherein the plurality of discharge unit parts is configured for each color of liquid droplets to be discharged and comprises:

a first unit group formed by a discharge unit part discharging black liquid droplets; and a second unit group formed by a discharge unit part discharging liquid droplets having a color other than black, and wherein the damper chamber of the discharge unit part at a first end of the first unit group in the second direction and the damper chamber of the discharge unit part at a second end of the first unit group have the same arrangement of the pillar part.

* * * * *